US007898380B2

(12) United States Patent
Van Heerden

(10) Patent No.: US 7,898,380 B2
(45) Date of Patent: Mar. 1, 2011

(54) DROPOUT FUSE ASSEMBLY AND FUSE HOLDER

(75) Inventor: Anton Van Heerden, East London (ZA)

(73) Assignee: Lukas Marthinus Fick, Pretoria, Gauteng Province (ZA)

( * ) Notice: Subject to any disclaimer, the term of this patent is extended or adjusted under 35 U.S.C. 154(b) by 46 days.

(21) Appl. No.: 12/473,153

(22) Filed: May 27, 2009

(65) Prior Publication Data

US 2009/0322463 A1 Dec. 31, 2009

Related U.S. Application Data

(63) Continuation of application No. PCT/IB2007/003699, filed on Nov. 30, 2007.

(51) Int. Cl.
*H01H 85/56* (2006.01)
*H01H 85/60* (2006.01)

(52) U.S. Cl. ..... 337/285; 337/237; 337/170; 337/171; 337/176; 337/177; 337/217; 337/218; 337/256; 337/257; 337/258; 337/283; 337/284; 337/286

(58) Field of Classification Search ..... 337/237, 337/168–181, 217–220, 256–258, 283–286
See application file for complete search history.

(56) References Cited

U.S. PATENT DOCUMENTS 1,352,816 A * 9/1920 Klauber ..... 337/286
1,569,981 A * 1/1926 Johnson, Jr. ..... 337/286
1,894,056 A * 1/1933 Pittman et al. ..... 337/285
1,919,453 A * 7/1933 Sumpter ..... 337/285
1,923,323 A * 8/1933 Medlin ..... 337/285
1,940,575 A * 12/1933 Boll ..... 337/288
1,953,392 A * 4/1934 Carlisle ..... 337/285
1,954,634 A * 4/1934 Lemmon et al. ..... 337/285
1,965,391 A * 7/1934 Pittman et al. ..... 337/285
1,991,064 A * 2/1935 Schultz et al. ..... 337/286

(Continued)

FOREIGN PATENT DOCUMENTS

EP 593162 A1 * 4/1994

(Continued)

OTHER PUBLICATIONS

International Search Report dated May 19, 2008.

*Primary Examiner* — Anatoly Vortman
(74) *Attorney, Agent, or Firm* — Knobbe, Martens, Olson & Bear LLP

(57) ABSTRACT

A fuse holder (20) is provided that can be installed in the place of a dropout fuse element in an electrical insulating unit (1). The fuse holder has an elongate electrically insulating body providing at least one electrically insulated elongate fuse housing in the form of a passage (21) associated with the body and adapted to receive a fuse wire (22) held under tension therein. The body can be installed in such insulating unit as a replacement to an existing dropout fuse element (5) and itself provides contacts enabling such a conventional dropout fuse element to be installed in the fuse holder body from which it can drop out when the fuse is blown. A switch arrangement is provided for maintaining a fuse in the passage in an inoperative condition whilst a dropout fuse element is functional and for automatically closing an electrical circuit through a fuse installed in said passage when the dropout fuse becomes blown and drops out of the fuse holder.

8 Claims, 7 Drawing Sheets

U.S. PATENT DOCUMENTS

| | | | | | |
|---|---|---|---|---|---|
| 1,993,083 | A | * | 3/1935 | Boll | 337/286 |
| 2,051,771 | A | * | 8/1936 | Schultz et al. | 337/284 |
| 2,052,671 | A | * | 9/1936 | Schultz et al. | 337/288 |
| 2,059,796 | A | * | 11/1936 | Johnson | 200/34 |
| 2,063,466 | A | * | 12/1936 | Schultz et al. | 337/173 |
| 2,089,387 | A | * | 8/1937 | Lemmon | 337/283 |
| 2,155,959 | A | * | 4/1939 | Smythe | 337/286 |
| 2,175,904 | A | * | 10/1939 | Lincks | 337/285 |
| 2,189,588 | A | * | 2/1940 | Lincks | 337/288 |
| 2,192,710 | A | * | 3/1940 | Lemmon | 337/288 |
| 2,204,299 | A | * | 6/1940 | Carlisle | 337/284 |
| 2,209,396 | A | * | 7/1940 | Fox | 337/288 |
| 2,211,974 | A | * | 8/1940 | Hendricks | 337/285 |
| 2,217,589 | A | * | 10/1940 | Fox | 337/288 |
| 2,240,253 | A | * | 4/1941 | Birkenmaier | 337/286 |
| 2,265,766 | A | * | 12/1941 | Schultz et al. | 337/287 |
| 2,284,845 | A | * | 6/1942 | Rawlins et al. | 337/286 |
| 2,291,647 | A | * | 8/1942 | Ramsey | 337/287 |
| 2,307,208 | A | * | 1/1943 | Fox | 337/286 |
| 2,320,026 | A | * | 5/1943 | Birkenmaier | 337/287 |
| 2,348,029 | A | * | 5/1944 | Smith, Jr. | 337/286 |
| 2,367,090 | A | * | 1/1945 | Birkenmaier | 337/286 |
| 2,378,582 | A | | 6/1945 | Salter | |
| 2,464,299 | A | * | 3/1949 | Fox | 337/288 |
| 2,519,078 | A | * | 8/1950 | Schultz | 337/287 |
| 2,548,129 | A | * | 4/1951 | Steinmayer | 337/288 |
| 2,563,558 | A | * | 8/1951 | Schultheiss | 337/286 |
| 4,008,452 | A | * | 2/1977 | Cameron | 337/284 |
| 4,321,575 | A | * | 3/1982 | Koszewa et al. | 337/168 |
| 5,796,326 | A | * | 8/1998 | Benito | 337/169 |
| 7,012,498 | B2 | * | 3/2006 | Van Heerden | 337/286 |
| 2004/0239473 | A1 | * | 12/2004 | Van Heerden | 337/171 |

FOREIGN PATENT DOCUMENTS

| | | | |
|---|---|---|---|
| GB | 2 299 718 | A | 10/1996 |
| WO | WO 03/021619 | A1 | 3/2003 |

* cited by examiner

DROPOUT FUSE ASSEMBLY AND FUSE HOLDER

CROSS-REFERENCE TO RELATED APPLICATIONS

This application is a continuation of International Application Number PCT/IB2007/003699, titled "DROPOUT FUSE ASSEMBLY AND FUSE HOLDER", filed on Nov. 30, 2007, which claims the benefit of South African Application Number 2006/10068, filed on Dec. 1, 2006. The above-referenced applications are incorporated by reference in their entireties.

BACKGROUND OF THE INVENTION

1. Field of the Invention

This application relates to a dropout fuse assembly and to a fuse holder forming a part thereof whereby a repeater fuse characteristic may be imparted to an installation having conventional dropout fuse elements with the result that electrical continuity can be automatically restored in the event of at least a first fuse of the assembly blowing.

2. Description of the Related Art

Fuses may be used extensively in high voltage electrical networks, such as at distribution points, in order to protect electrical equipment in the network from damage caused by electrical surges through the system, generally occasioned by short-circuits (including those resulting from lightning strikes), and overloads. Although such a surge is often of a very temporary nature, such as may be caused by lightning, a fuse will nevertheless blow irrespective of whether the temporary surge is likely to repeat itself soon, if ever.

In the absence of a fuse holder assembly that can automatically connect sequentially to a second fuse, and possibly even a third fuse, one at a time, the consumers supplied through that particular circuit will be subjected to a power interruption that can be extremely inconvenient, harmful and costly. As a result of the fact that electrical distribution lines generally extend over long distances with poor vehicular access, it may take a considerable length of time to locate a fault and repair it. To make matters worse, such power interruptions often occur at night time, or in bad weather, or both. All this can contribute to extended periods of time for which the power supply remains interrupted.

In order to facilitate the location of a blown fuse, and its replacement, dropout fuse assemblies may be widely used in which instance a fuse wire that extends through a tubular fuse element is itself employed to hold an articulated link in an extended position. When the fuse wire blows, the tubular fuse element drops out of its operative position and hangs, typically upside down, from the articulated link thereby being highly visible and facilitating replacement. Elongate tools are available to enable such tubular fuse elements, at least in some instances, to be replaced by an electrician standing on the ground.

In order to combat the deleterious effects of downtime consequent on a temporary surge that is unlikely to be repeated, various so-called repeater fuses have been proposed, and used. Such repeater fuse assemblies usually have at least a second and possibly a third fuse element stored in the assembly with a mechanism triggered by the loss of tension in a fuse wire that blows so that another fuse is automatically connected into the relevant circuit by the mechanism.

Such repeater fuse assemblies are described, for example, in UK Patent Number GB 2299718; in U.S. Pat. No. 2,378,582; and in International Patent Application Number WO03/021619. Whilst these arrangements may operate effectively, they may be complicated, accordingly costly, and may not enable blown fuses to be replaced without interrupting the relevant power supply.

U.S. Pat. No. 2,211,974, on the other hand, does provide an arrangement in which a fuse can be replaced without interrupting the power supply but the fuse assembly is extremely complicated and, applicant believes, relatively costly.

These repeater fuse assemblies also suffer from the disadvantage that there is an inadequate time delay between the one fuse blowing and the other becoming connected to enable the arc created by the blown fuse to clear adequately.

In any event, each of these proposals requires replacement of the entire fuse assembly in order to implement them with the accompanying power interruptions and both direct and indirect costs. Still further, in at least one instance, installation into a network requires that the system be modified with accompanying necessary downtime.

It will be understood that the nature of a fuse with which certain embodiments are concerned is that the fuse itself generally forms part of the length of a fuse wire that passes through and insulating passage in a fuse element or holder and that both the fuse and fuse wire may typically be held in tension in the operative condition.

SUMMARY OF THE INVENTION

One embodiment provides a simplified fuse holder assembly in which a plurality of fuses is arranged for automatic sequential connection into a circuit in the event that one fuse blows. Another embodiment provides a fuse holder that enables, as may be required, existing components of a dropout type of fuse to be used as a part of the composite fuse holder assembly.

In one embodiment there is provided a fuse holder comprising an elongate electrically insulating body providing at least one electrically insulated elongate fuse housing in the form of a passage associated with the body and adapted to receive a fuse wire held under tension therein, first contact means at one end of the body and second contact means at the other end of the body wherein the first contact means and second contact means are configured for cooperation with cooperant first and second mating contacts of an insulator unit of a dropout fuse assembly such that the body can be installed in such insulating unit as a replacement to an existing dropout fuse element, the fuse holder being characterized in that the first contact means is electrically connected to first cooperant mating contact means on the fuse holder body and the second contact means is electrically connected to second mating contact means on the fuse holder body such that a dropout fuse element can be installed on the fuse holder body between said first and second cooperant mating contact means on the fuse holder body, the fuse holder being further characterized in that electrical conductors are provided in or on the body for defining an electrical circuit between the first and second contact means that operatively includes a fuse installed in said passage and switch means adapted to be held open whilst a dropout fuse element is installed between said first and second cooperant mating contact means on the body and wherein such switch means is adapted to automatically close, in use, when such dropout fuse element that is installed between said first and second cooperant mating contact means on the body drops out in consequence of its fuse being blown.

Another embodiment provides for the first contact means on the body to include a generally domed contact surface for snap cooperation with a resilient first cooperant mating contact on an insulator unit having a cooperant recess for receiving the domed contact surface; for the second contact means on the body to be an articulated contact assembly including spring loaded tensioning means for holding a fuse wire in tension and wherein the articulated contact assembly includes catch means for holding it in an extended condition whilst the tension means is held under tension in a fuse wire and for releasing the catch to allow collapse of the articulated contact to allow dropout of an associated fuse element when tension in the fuse wire is released; and for the said first and second cooperant mating contact means on the body to be substantial replicas of the first and second cooperating contacts on a cooperant insulating unit.

Yet another embodiment provides for the electrical conductors defining the circuit that includes a fuse installed in said passage to include a first electrical conductor in electrical contact with the first contact means and that extends through the body to terminate in a first switch contact on one side of the body and a second electrical conductor extending through the body from a second switch contact on an opposite side of the body to operatively electrically connect with a fuse wire installed in said passage, wherein the fuse is associated with said articulated contact assembly forming said second contact means on the body; and for a generally U-shaped bridging member that forms part of the switch means to be provided that is rotatable about an axis extending across the U-shaped bridging member at generally right angles to the arms thereof and that is resiliently angularly biased towards an operative terminal position in which its arms are in electrical contact with the first and second switch contacts to close a circuit between the first contact means and second contact means by way of a fuse wire in the passage; and for retaining means to be provided for retaining the bridging member in an inoperative terminal position in which it is out of contact with said first and second contact means, the retaining means being releasable upon or during the dropping out of a dropout fuse element extending operatively between the first and second mating contact means on the body of the fuse holder.

Briefly, and as will become more apparent from the following, the fuse holder defined above can, in practice, be installed in a suitable dropout insulator unit in place of a dropout fuse element, and the same dropout fuse element that has been removed from the insulator unit can then be installed between the first and second cooperant mating contact means on the body of the fuse holder. The fuse element provides the first fuse circuit that serves as the only fuse whilst the switch means is held open by the presence of the fuse element and if the first fuse wire is blown, the switch means on the fuse holder body is triggered to close and complete a circuit that then includes a fuse wire installed in the passage of the body. It is to be noted that the trigger means is preferably arranged such that it is activated only when the fuse element has dropped significantly and this automatically provides an appropriate time delay to enable the arc generated when the fuse blew to clear before the next fuse is connected into the circuit.

In order that the application may be more fully understood one embodiment thereof will now be described with reference to the accompanying drawings.

DETAILED DESCRIPTION OF THE INVENTION

In order that the practical application of this particular embodiment be properly appreciated, a brief description of a relevant existing dropout fuse arrangement will precede the description of the embodiment itself.

Figure 1:
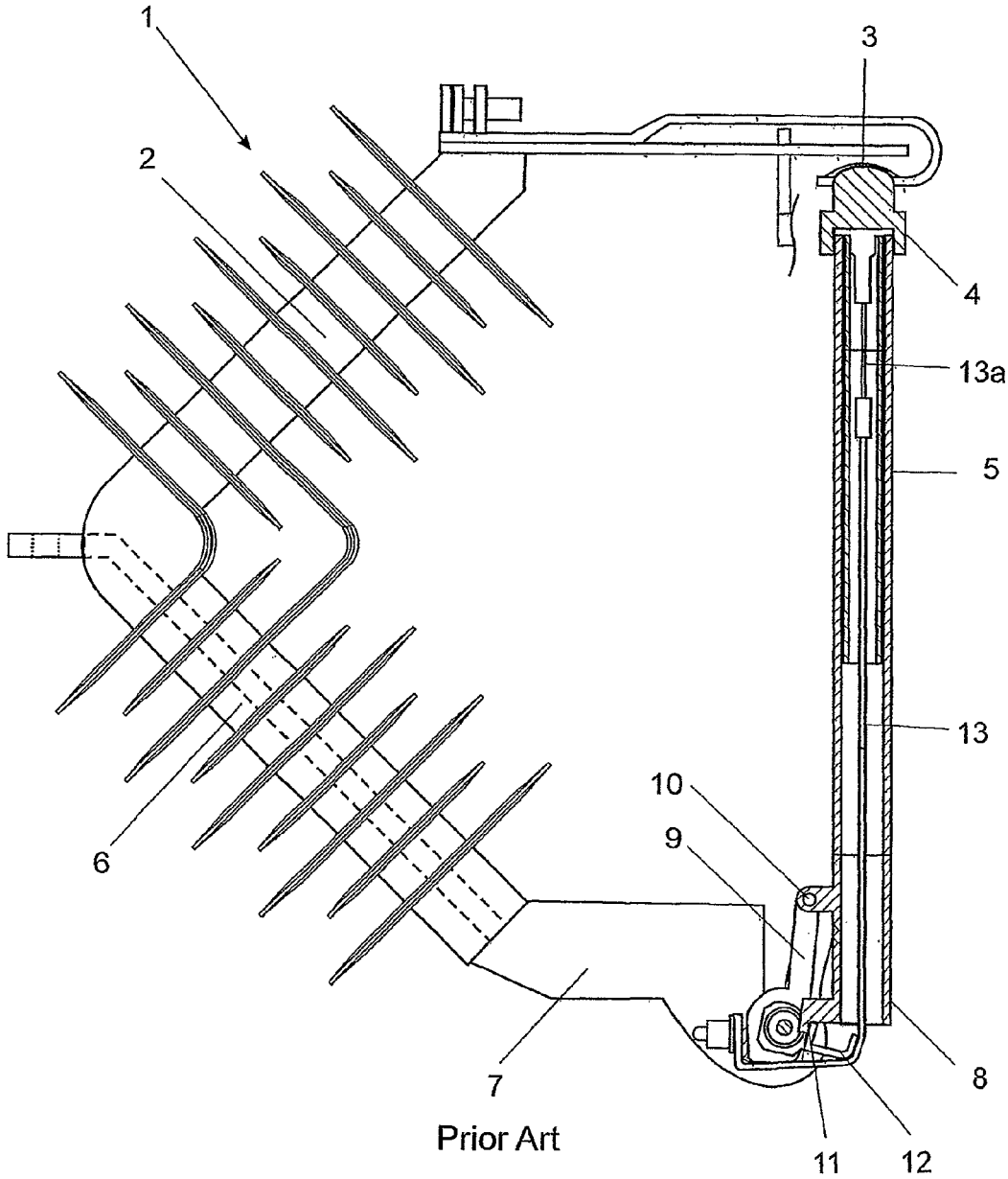
FIG. 1 is a side elevation of a prior art dropout fuse assembly in conjunction with which the embodiment described below is designed to be used illustrating a fuse element in its operative position in an associated insulator unit.

In an existing arrangement, and as illustrated in FIG. 1, an electrical insulator unit (1) of a type typically used as a distribution cutout, has, at the end of a first arm (2) a first mating contact (3) in the form of an electrically conductive resilient leaf having a recess that operatively receives, in snap fit relationship, a domed contact surface of a nut (4) carried at one end of a tubular fuse element (5).

A second arm (6) of the insulator unit has a second mating contact (7) in the form of a bifurcated cradle that receives a relatively rotatable articulated contact assembly (8) at the opposite end of the tubular fuse element (5).

Figure 2:
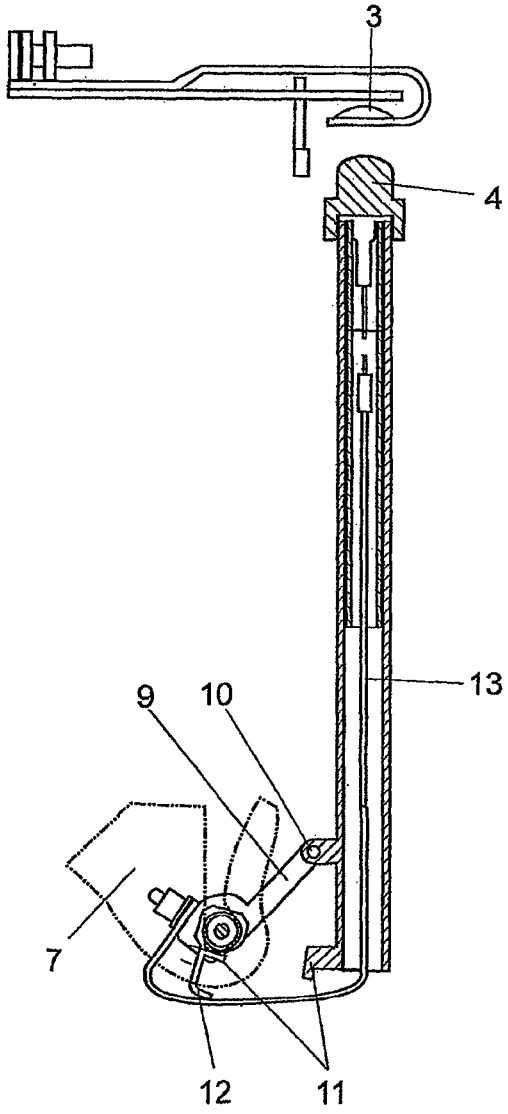
Prior Art Figure 2
FIG. 2 illustrates the initial movement of the drop out mechanism illustrated in FIG. 1 following on blowing of the fuse therein.
Figure 3:
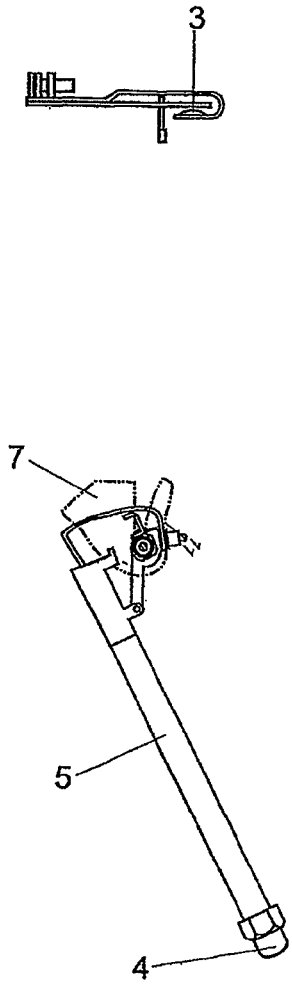
Prior Art Figure 3
FIG. 3 is the same as FIG. 2 on a reduced scale showing the fuse element fully dropped out.
Figure 4:
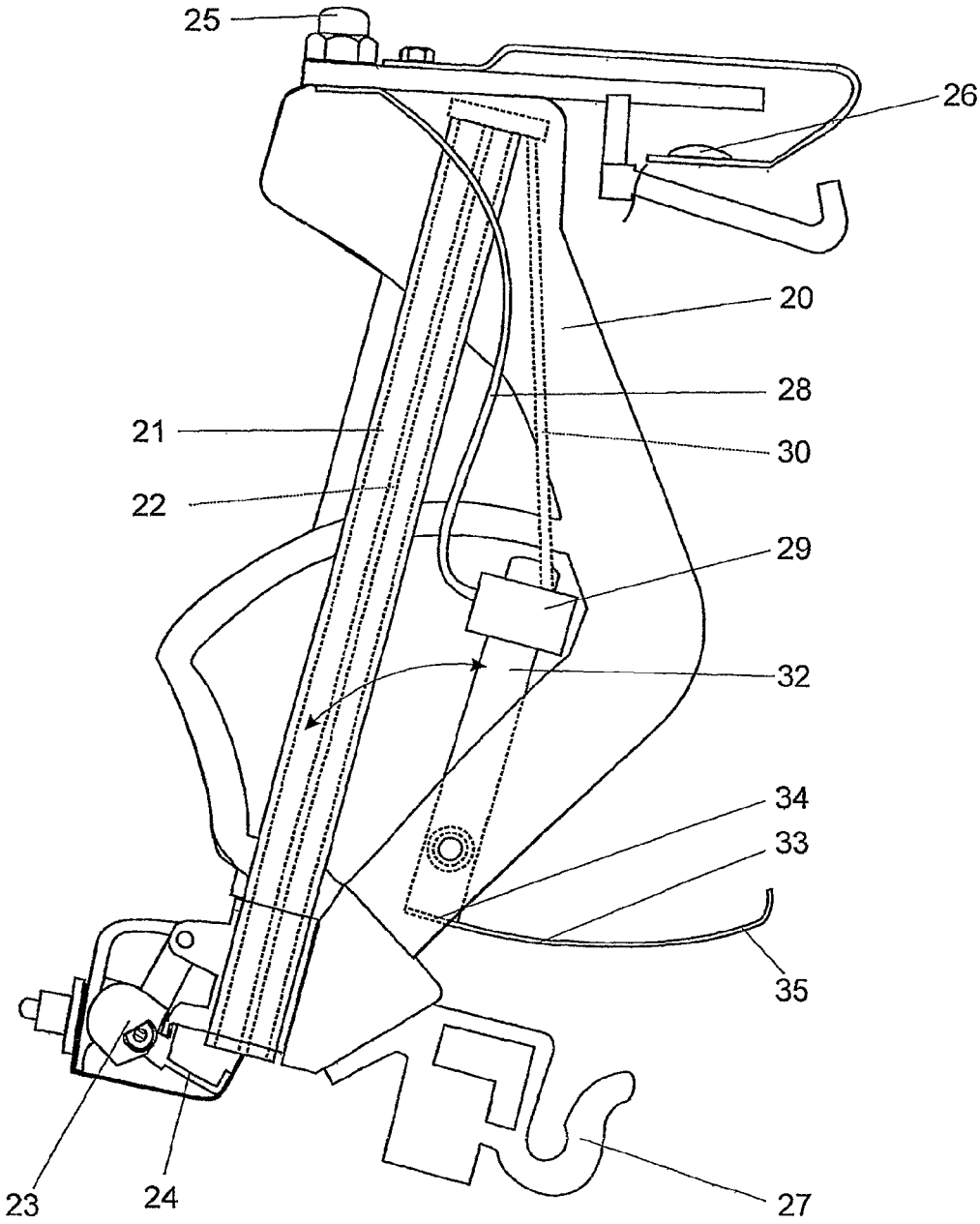
FIG. 4 is a schematic side elevation of one embodiment of fuse holder according to one embodiment.

Simply for the sake of completeness of disclosure, and with particular reference to FIGS. 1 to 3 of the drawings, the articulated contact assembly comprises a pivotally mounted link (9) supported by the cradle and pivotally attached to the tubular fuse element by a pivot (10) spaced upwards of the lower end of the element.

A catch (11) maintains the link in its extended orientation roughly parallel to the tubular fuse element, in use, the catch being movable in unison with a spring loaded tensioning flap (12) that imposes a tension on a fuse wire (13) and that embodies a fuse (13*a*) passing through the tubular fuse element.

The arrangement is one that is well-known wherein, consequent on the blowing of the fuse and the resultant rotation of the flap to draw the fuse wire outwards, as illustrated in FIG. 2, the catch is released and allows collapse of the articulated contact by virtue of rotation of the link (9) relative to the tubular fuse element and a collapse of its effective length. The result is that the associated fuse element drops out of the insulating unit and hangs downwards on the articulated contact assembly, as illustrated in FIG. 3.

Reverting now to the embodiment that is illustrated in FIGS. 4 to 8, an elongate fuse holder (20) made of electrically insulating material has an electrically insulated elongate fuse housing in the form of a passage (21) associated with the body and adapted to receive a fuse wire (22) held under tension therein by means of an articulated contact assembly (23), as described above, that includes a tensioning flap (24), the articulated contact assembly forming the second contact means defined above. The fuse holder body also has first contact means in the form of a domed nut (25) at its other end.

The arrangement is thus such that the fuse holder itself can be installed between the first mating contact (3) of the insulator unit and the second mating contact or cradle (7) in exactly the same manner as the dropout fuse element itself, and as a replacement therefor.

The first contact means or domed nut (25) is electrically connected to first cooperant mating contact means (26) on the fuse holder body that is substantially identical to the first mating contact (3) on the insulator unit. The articulated contact assembly (23), being the second contact means, is electrically connected to a second mating contact means on the body of the fuse holder that assumes the form of a substantially identical cradle (27).

This arrangement is such that a dropout fuse element (5) can be installed on the fuse holder body between said first and second cooperant mating contact means in substantially conventional manner, the only difference being that it is now carried by the fuse holder of this embodiment rather than directly by the insulator unit.

It will thus be understood that the tubular fuse element (5) with the fuse therein intact, closes the circuit from the first contact means or domed nut (25) to the articulated contact assembly (23).

In this condition the circuit through the fuse wire (22) in the passage (21) of the fuse holder is electrically isolated. Electrical connections for this fuse wire include a first electrical conductor (28) provided in the body in electrical contact with the first contact means or domed nut (25) and this first electrical conductor terminates in a first switch contact (29) on one side of the body (see particularly FIG. 8). A second electrical conductor (30) extends through the body from a second switch contact (31) on an opposite side of the body to electrically connect with the fuse wire (22) installed in said passage, and thence with the substantially identical cradle (27).

Figure 5:
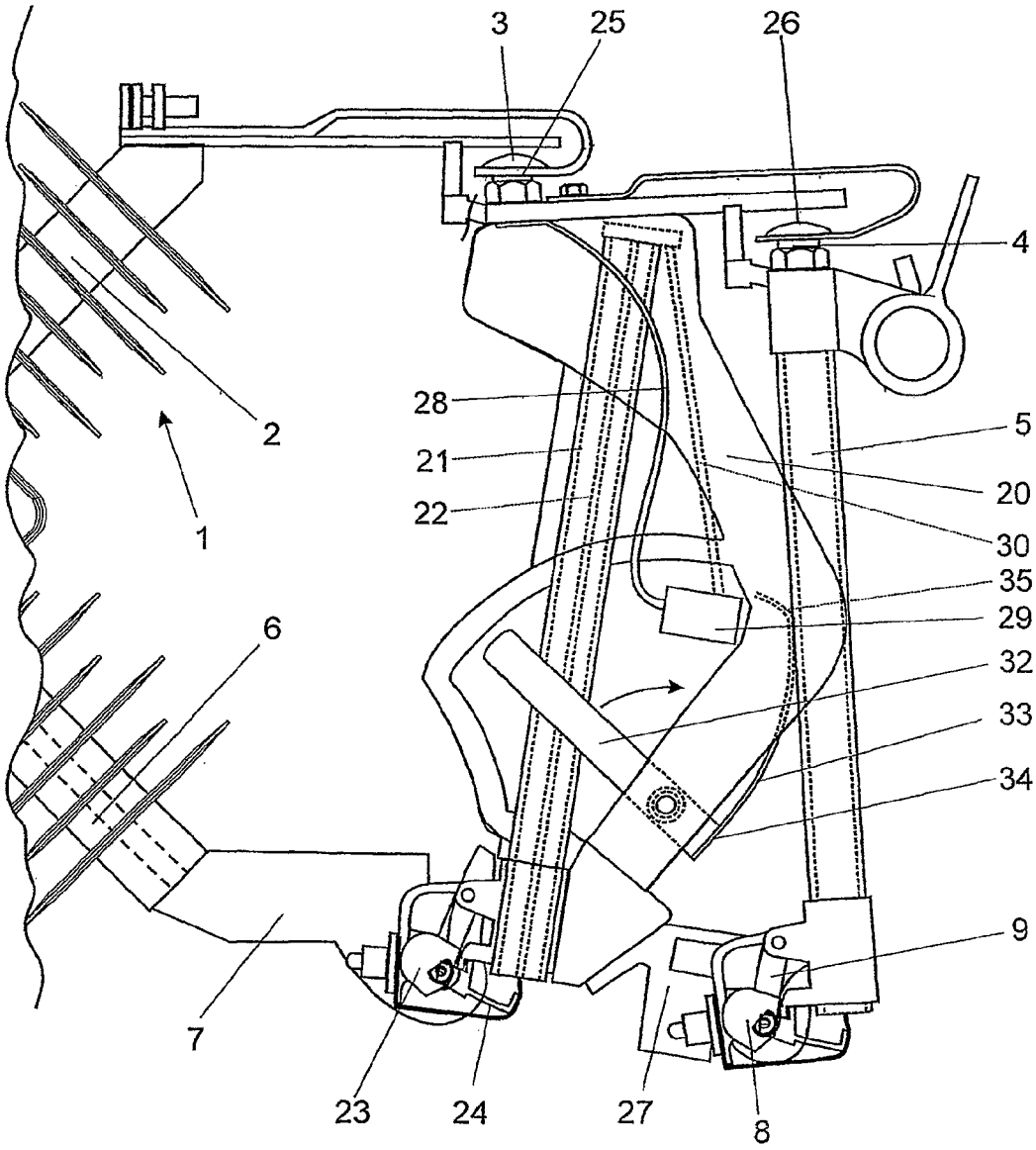
FIG. 5 is a schematic side elevation of the fuse holder of FIG. 4 installed in a prior art insulator unit of a dropout fuse assembly of the type illustrated in FIG. 1.

An electrically conductive U-shaped bridging member (32) is pivotally mounted to the body and spring loaded towards a position in which its arms contact both of the first and second switch contacts (29, 31) in order to close the circuit to the fuse wire (22), that is, by movement in a clockwise direction in the illustrated view. This bridging member is held against the spring loading thereof in an inoperative position by a leaf spring (33) fixed at one end (34) to the bridging member so as to be rotatable in unison therewith. The other end region (35) of the leaf spring extends outwards into the line between the first mating contact means (26) and the substantially identical cradle (27) that defines the second mating contact means on the body such that tubular fuse element (5), when installed in its operative position that is illustrated in FIG. 5, urges the bridging member against its own spring loading to the inoperative position.

This arrangement is such that when the tubular fuse element (5) drops out of its operative position in consequence of its fuse becoming blown the leaf spring initially straightens out somewhat and after an initial movement, allows the bridging member to rotate under its own spring loading to its operative position in which it bridges the first and second switch contacts and completes the circuit through the fuse wire (22) passing through the passage (21). The arrangement is such that there is an adequate time delay from the instant that the fuse blows until the bridging member restores the connection for the arc generated to subside. In this particular instance, the time period is approximately 1.2 seconds.

It will be apparent from the foregoing, that the fuse holder provided by this embodiment may be installed in a suitable dropout insulator unit in place of a dropout fuse element, and the same dropout fuse element that has been removed from the insulator unit can then be installed in the fuse holder as indicated above.

Figure 6:
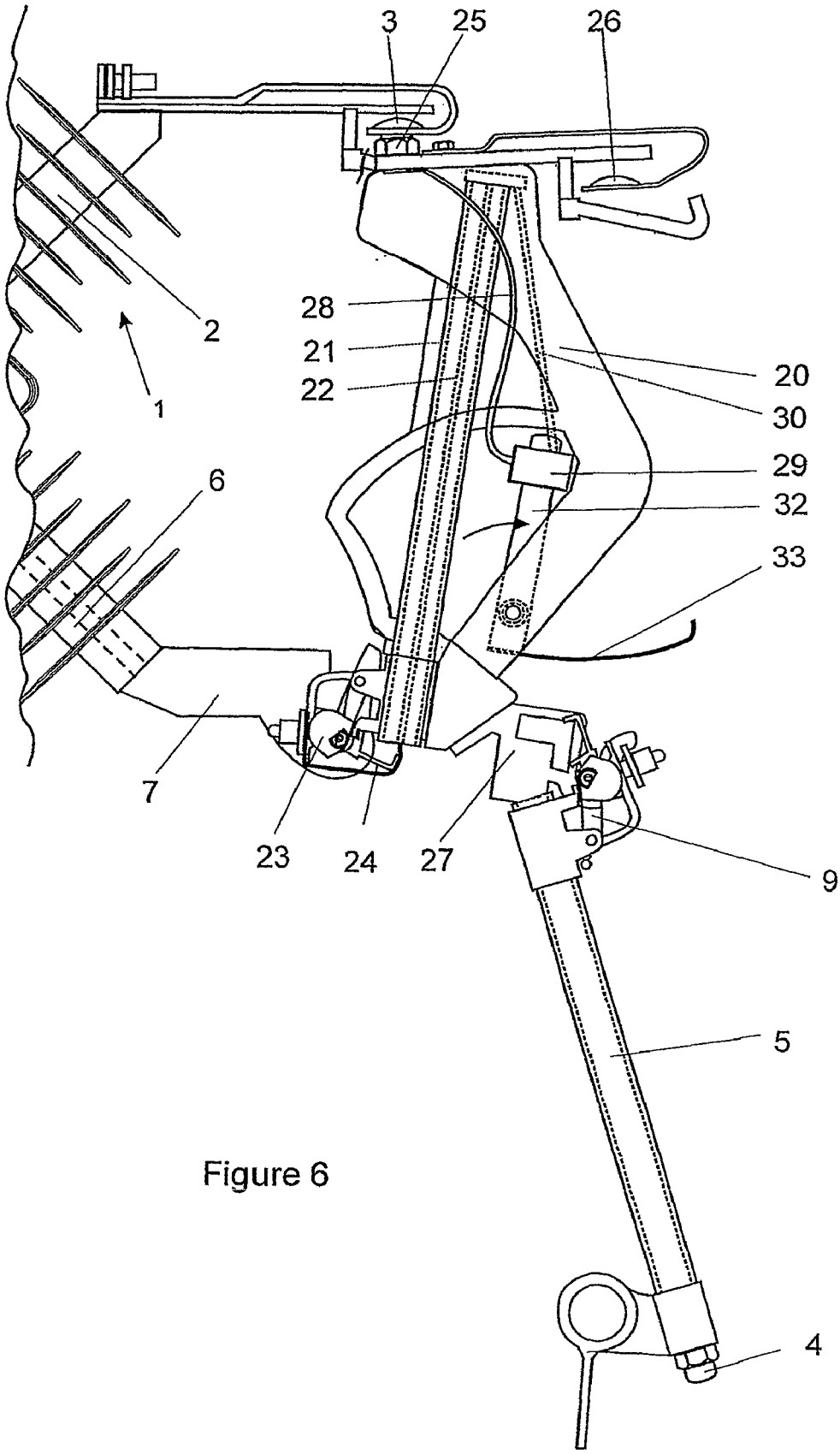
FIG. 6 is the same as FIG. 5 but illustrating the fuse element in a dropped out condition following on blowing of the fuse therein.

The fuse element itself thus provides a first fuse circuit that operates normally, but in this case relative to the fuse holder, until such time as the relevant fuse becomes blown. At that stage it will dropout of the fuse holder to a position as illustrated in FIG. 6. This will cause the U-shaped bridging element to be triggered to move to its operative position in which the fuse wire (22) in the passage through the body of the fuse holder is rendered operative and power is automatically restored to the circuit.

Figure 7:
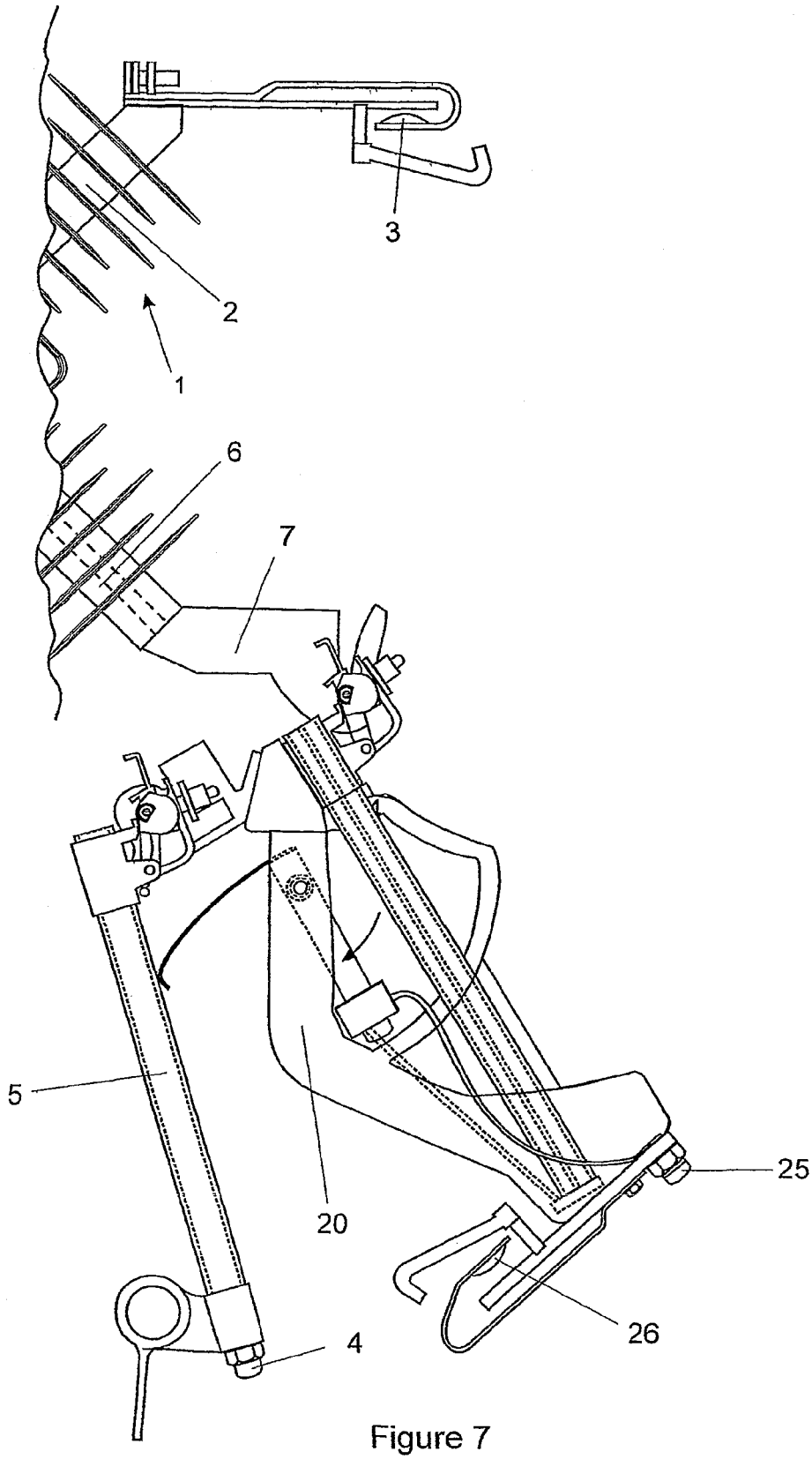
FIG. 7 is the same as FIG. 6 but illustrating the fuse holder itself in a dropped out condition following on blowing of the fuse contained in the passage thereof; and, FIG. 8 is a schematic edge-on view of the fuse holder showing the electrical circuit through the body.
Figure 8:
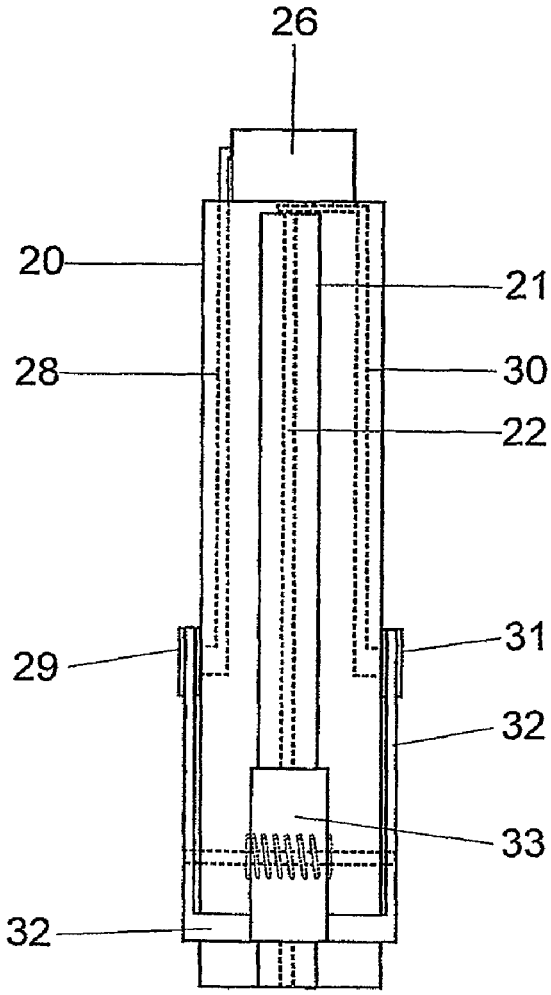

In the event that the fault causing the tubular dropout fuse to blow is not removed, that is to say it was not a transient fault, then the fuse in the fuse wire (22) will blow and the entire fuse holder of this embodiment will dropout of the insulator unit in the manner of a conventional dropout fuse and to a position that is illustrated in FIG. 7.

Of course, in the event that the fault is a transient one, the fuse holder described above enables the blown fuse to be replaced without any appreciable interruption of the power supply.

It will therefore be appreciated that this embodiment provides an extremely simple yet highly effective fuse holder that can be simply installed in an existing insulator unit to replace a tubular fuse element and the same tubular fuse element can be installed in the fuse holder thereby providing a repeater fuse attribute where there was previously none. The fact that the same fuse element that has been removed to make way for the fuse holder is then installed in the fuse holder ensures that there are absolutely no redundant parts generated by fitting fuse holders according to this embodiment.

Numerous variations may be made to the embodiment described above without departing from the scope thereof.

What is claimed is:

1. A fuse holder comprising an elongate electrically insulating body providing at least one electrically insulated elongate fuse housing in the form of a passage associated with the body and adapted to receive a fuse wire held under tension therein, a first contact at one end of the body and a second contact at the other end of the body wherein the first contact and second contact are configured for cooperation with cooperant first and second mating contacts of an insulator unit of a dropout fuse assembly such that the body can be installed in such insulator unit as a replacement to an existing dropout fuse element, wherein the first contact is electrically connected to first cooperant mating contact on the fuse holder body and the second contact is electrically connected to second mating contact on the fuse holder body such that a dropout fuse element can be installed on the fuse holder body between said first and second cooperant mating contact on the fuse holder body, wherein electrical conductors are provided in or on the body for defining an electrical circuit between the first and second contact that operatively includes a fuse installed in said passage and a switch adapted to be held open whilst a dropout fuse element is installed between said first and second cooperant mating contact on the body and wherein such switch is adapted to automatically close, in use, when such dropout fuse element that is installed between said first and second cooperant mating contact on the body drops out in consequence of its fuse being blown.

2. The fuse holder of claim 1 in which the first contact on the body includes a generally domed contact surface for snap cooperation with a resilient first cooperant mating contact on an insulator unit having a cooperant recess for receiving the domed contact surface.

3. The fuse holder of claim 1 in which the second contact on the body is an articulated contact assembly including a spring loaded tensioner for holding the fuse wire in tension and a catch for holding it in an extended condition whilst the fuse wire is under tension and for releasing the catch to allow collapse of the articulated contact and allow dropout of the associated fuse element when tension in the fuse wire is released.

4. The fuse holder of claim 1 wherein said first and second cooperant mating contacts on the body of the fuse holder are substantial replicas of the first and second cooperating contacts on a cooperant insulator unit.

5. The fuse holder of claim 1 wherein the electrical conductors defining the circuit that includes said fuse installed in said passage include a first electrical conductor in electrical contact with the first contact and that extends through the body to terminate in a first switch contact on one side of the body and a second electrical conductor extending through the body from a second switch contact on an opposite side of the body to operatively electrically connect with the fuse wire installed in said passage.

6. The fuse holder of claim 1 wherein the switch comprises a generally U-shaped bridging member that is rotatable about an axis extending across the U-shaped bridging member at generally right angles to the arms thereof and that is resiliently angularly biased towards an operative terminal position in which its arms are in electrical contact with a first and a second switch contacts to close a circuit between the first contact and second contact by way of the fuse wire in the passage.

7. The fuse holder of claim 6 wherein at least one retainer is provided for retaining the bridging member in an inoperative terminal position in which it is out of contact with said first and second switch contacts, the retainers being releasable upon or during the dropping out of the dropout fuse element extending operatively between the first and second mating contacts on the body of the fuse holder.

8. The fuse holder of claim 7 wherein the at least one retainer is in the form of a leaf spring one end of which is fixed to the bridging member so as to be rotatable in unison therewith and the other end a region of which cooperates, in use, with a tubular fuse element installed in the fuse holder to hold the bridging member in its inoperative terminal position and wherein the resilient angular biasing of the bridging member urges it into contact with the first and second switch contacts in the absence of said tubular fuse element in the operative position.

* * * * *